US005359772A

United States Patent [19]

Carlsson et al.

[11] Patent Number: 5,359,772

[45] Date of Patent: * Nov. 1, 1994

[54] METHOD FOR MANUFACTURE OF A ROLL RING COMPRISING CEMENTED CARBIDE AND CAST IRON

[75] Inventors: Jan-Erik Carlsson, Singapore, Singapore; Gert Sundstedt, Bergisch Gladbach, Germany

[73] Assignee: Sandvik AB, Sandviken, Sweden

[ * ] Notice: The portion of the term of this patent subsequent to Apr. 14, 2009 has been disclaimed.

[21] Appl. No.: 70,943

[22] Filed: Jun. 4, 1993

Related U.S. Application Data

[60] Division of Ser. No. 833,750, Feb. 11, 1992, Pat. No. 5,248,289, which is a continuation-in-part of Ser. No. 658,651, Feb. 21, 1991, Pat. No. 5,104,458, which is a division of Ser. No. 449,820, Dec. 13, 1989, Pat. No. 5,044,056.

[30] Foreign Application Priority Data

Feb. 11, 1991 [SE] Sweden ..... 9100405

[51] Int. Cl.[5] ..... B21B 31/08

[52] U.S. Cl. ..... 29/895.32; 29/895.3

[58] Field of Search ..... 148/321, 324; 29/895, 29/895.3, 895.32; 492/28, 30, 39, 47, 53, 54, 58, 59

[56] References Cited

U.S. PATENT DOCUMENTS 3,609,849 10/1971 Krol .
3,659,323 5/1972 Hachisu et al. .
3,787,943 1/1974 Loqvist .
3,807,012 4/1974 Loqvist .
3,860,457 1/1975 Vourinen et al. .
3,997,370 12/1976 Horvath, Jr. et al. .
4,099,311 7/1978 Kark .
4,119,459 10/1978 Ekemar et al. .
5,044,056 9/1991 Sundstedt et al. .
5,104,458 4/1992 Sundstedt et al. .

FOREIGN PATENT DOCUMENTS 3248482 12/1982 Germany .
60-27407 2/1985 Japan .

OTHER PUBLICATIONS

J. F. Janowak et al., "Approaching Austempered Ductile Iron Properties by Controlled Cooling in the Foundry", J. Heat Treating, American Society for Metals, vol. 4, No. 1, Jun. 1985, pp. 25–31.

Abstract for Swedish Patent Application 86-03987-2, filed Mar. 24, 1988.

A. E. Krivosheev, "Cast Rolls (Theoretical and Technological Fundamentals of Production)", Moscow, 1957, pp. 272–274.

S. B. Yudin et al., "Centrifugal Casting", 2nd Revised and Supplemental Edition, Mashinostroenie Publishers, Moscow, 1972, p. 240.

*Primary Examiner*—Mark Rosenbaum
*Assistant Examiner*—David P. Bryant
*Attorney, Agent, or Firm*—Burns, Doane, Swecker & Mathis

[57] ABSTRACT

The present invention relates to a roll, comprising cemented carbide and cast iron, and a method for manufacture of the same. The roll may be used for hot or cold rolling. The barrel comprises one or several cemented carbide rings, east by centrifugal casting method into a roll body of an iron alloy. The casting alloy comprises an essentially graphitic east iron, which after the casting contains residual austenitc. This residual austenitc is transformed at subsequent heat treatment step (or steps) totally or partly to mainly bainite under volume increase, with the aim of reducing or totally eliminating the differential shrinkage between the east iron and the cemented carbide as a result from cooling after the casting. The central part of the roll body may alternatively consist of another alloy.

5 Claims, 3 Drawing Sheets

METHOD FOR MANUFACTURE OF A ROLL RING COMPRISING CEMENTED CARBIDE AND CAST IRON

This application is a divisional of application Ser. No. 07/833,750, filed Feb. 11, 1992, now U.S. Pat. No. 4,548,289, which was a continuation-in-part of application Ser. No. 07/658,651, filed Feb. 21, 1991, now U.S. Pat. No. 5,104,456, which itself was a divisional of application Ser. No. 07/449,820, filed Dec. 13, 1989, now U.S. Pat. No. 5,044,056.

BACKGROUND OF THE INVENTION

The present invention relates to casting by the centrifugal casting method one or several cemented carbide rings into cast alloys based on iron, preferably cast iron. The resulting product is a composite roll, made in one piece only, with a metallurgical bond between cemented carbide and cast iron.

Composite rolls with cemented carbide for hot or cold rolling comprise one or several cemented carbide rings attached to a (driving) spindle by various couplings and locking devices. One method of transmitting the torque from the driving spindle to the cemented carbide roll is to use keyways or other driving grooves or driving lugs, made integral with the cemented carbide ring. However, cemented carbide is a brittle material with limited tensile strength and special notch sensitivity such as in inner corners in above-mentioned devices for the torque transmission. Methods based on such conventional joints have proved unsatisfactory. Another method for the torque transmission is by means of frictional forces at the bore surface of the cemented carbide ring. However, the radial force on this surface gives rise to tangential tensile stresses in the cemented carbide ring with a maximum at its inner diameter. These tensile stresses are added to other tensile stresses, generated when the roll is in use.

By casting a casing of an iron alloy onto a cemented carbide ring, a composite roll for hot or cold rolling is obtained in which required devices for torque transmission may be located to the cast iron. See, for example, Swedish patent no. 7100170-5, publication number 371114. However, this is not an entirely simple problem. Due to the fact that during cooling the casing shrinks more than the cemented carbide ring, inwardly directed forces on the cemented carbide ring are produced, giving rise to axially directed tensile stresses on the outer surface of the cemented carbide ring, which are acting perpendicularly to microcracks generated in the roll surface during rolling. Under the influence of these tensile stresses, the microcracks propagate in depth, which may cause roll breakage or need for excessive dressing amount, limiting the total rolling capacity of the roll.

A solution to this problem is described in U.S. Pat. No. 5,044,056, the disclosure of which is hereby incorporated by reference. According to that patent, one or several cemented carbide rings are cast into a casing of an iron alloy. The cast alloy comprises an essentially graphitic cast iron which after the casting contains residual austenite, preferably 15–20% by weight, which by one or more subsequent heat treatment steps totally or partly is transformed under volume increase to mainly bainite, with the differential shrinkage between the cast iron and the cemented carbide as a result being at least partly eliminated by the transformation of austenite to bainite during cooling after casting.

The method according to U.S. Pat. No. 5,044,056 permits the manufacture of roll rings which by couplings and locking devices on a driving spindle are assembled to a complete roll. Even if the necessary couplings for the torque transmission are made in the cast iron part, there are dimensional limitations and thereby a limit for the transmittable torque. Further, the wear resistant surface (the barrel) of the rolls is dimensionally restricted. According to the method of that patent or other existing systems of cemented carbide rolls operating by way of some kind of torque transmitting couplings, one is not totally free to place cemented carbide rings on the barrel because of space requiring couplings and locking devices. Thereby, the surface to be used for rolling becomes substantially restricted.

Centrifugal casting is a well-known technique for manufacture of usually rotary symmetric bodies. The technique utilizes the centrifugal force, accomplished by a rotating cylindrical mold, to sling the molten metal against the walls of the mold, where it solidifies under pressure to desired shape. The technique is commonly used for manufacture of tubes, linings, bushes, etc.., but is also used for manufacture of rolls. For example, in Swedish patent application no. 8603987-2, a composite roll for hot or cold rolling mills is disclosed, having a centrifugally east outer wear resistant layer or casing of a high alloyed cast steel and a core of a vermicular cast iron, ductile iron or simple cast steel.

OBJECTS AND SUMMARY OF THE INVENTION

It is an object of the present invention to avoid or alleviate the problems of the prior art.

It is an object of the present invention to provide an improved method for forming a roll for hot or cold rolling comprising cemented carbide rings cast into a casting alloy and the resulting roll.

In one aspect of the invention, there is provided the method of forming a roll ring comprising sintering a cemented carbide into a ring of predetermined size, thereafter casting iron about a portion of said cemented carbide ring to form a composite body barrel including a metallurgical bond between the cemented carbide and the cast iron, said cast iron having a microstructure comprising austenitc and bainite, said barrel being cast in one piece and thereafter heat treating the composite body to convert at least a portion of the austenite to bainite, the differential shrinkage during cooling after casting between the cast iron body and the ring of cemented carbide being at least partly eliminated by the transformation of austenitc to bainite.

In another aspect of the invention there is provided a roll, preferably for hot or cold rolling, comprising a barrel, at least one cemented carbide ring cast into the barrel and journals at the end of the barrel, in which the barrel comprises that said at least one cemented carbide ring cast into a casting alloy of a graphitic east iron having a microstructure predominantly of bainite, at least some of the bainite having been formed by heat treatment of austenitc, said at least one ring of cemented carbide being on at least a portion of the outer surface of the casting alloy, the cemented carbide being metallurgically bonded to said cast iron body during casting of the inner portion of the said cemented carbide ring, the differential shrinkage during cooling after casting between the east iron body and the ring of cemented carbide being at least partly eliminated by transformation of austenitc to bainite, said barrel, including said at least one cemented carbide ring, being cast in one piece.

BRIEF DESCRIPTION OF THE DRAWINGS

FIG. 1 shows a roll of ductile iron (1) in which a cemented carbide ring (2) is cast in.

FIG. 2 shows a roll of ductile iron (1) in which four cemented carbide tings (2) are cast in.

DETAILED DESCRIPTION OF THE PREFERRED EMBODIMENTS OF THE INVENTION

According to the invention, a composite roll is now provided made in one piece only by means of centrifugal casting with a metallurgical bond between cemented carbide and cast iron, where the barrel may be equipped with one or several cemented carbide tings according to actual rolling conditions and requirements. This freedom in design is possible to achieve only by the present invention.

Figure 1:
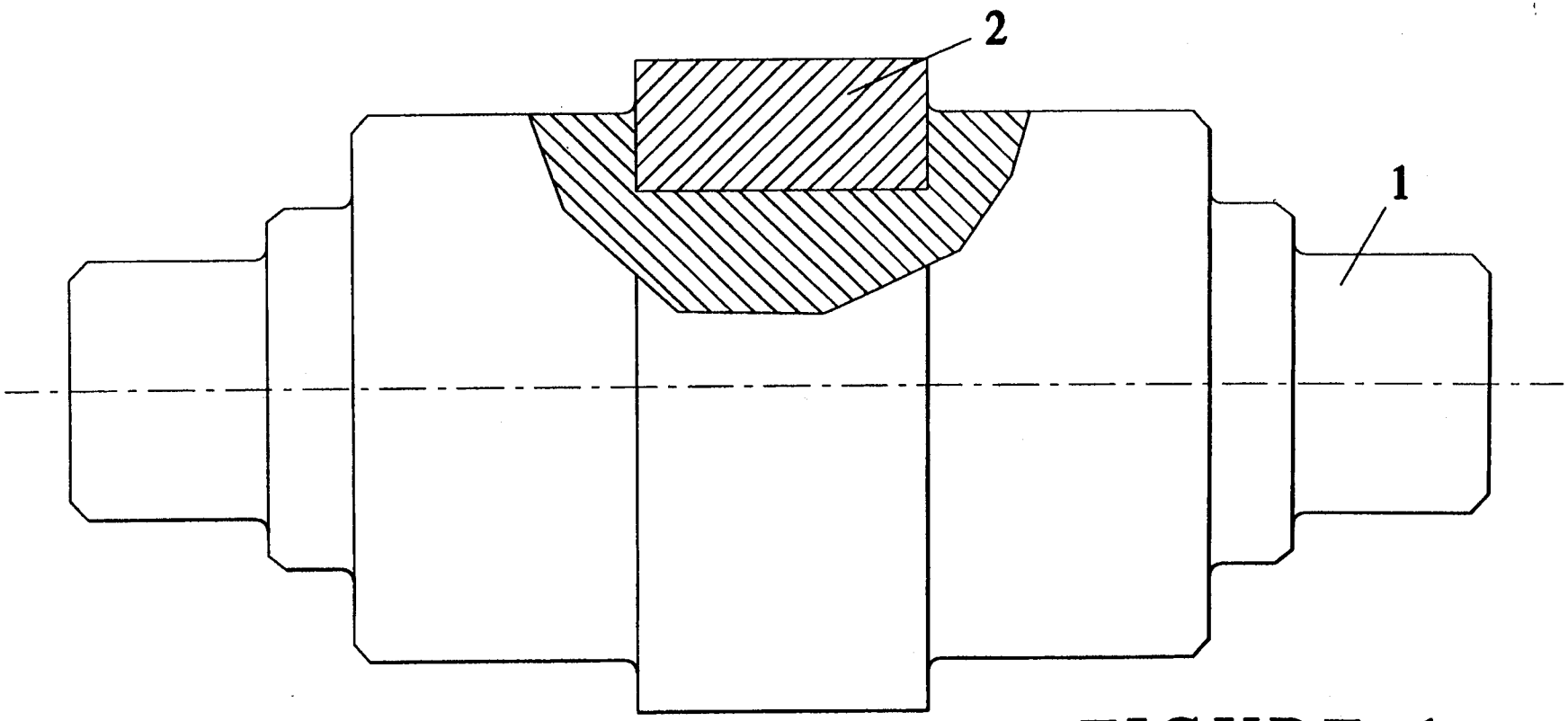
Figure 2:
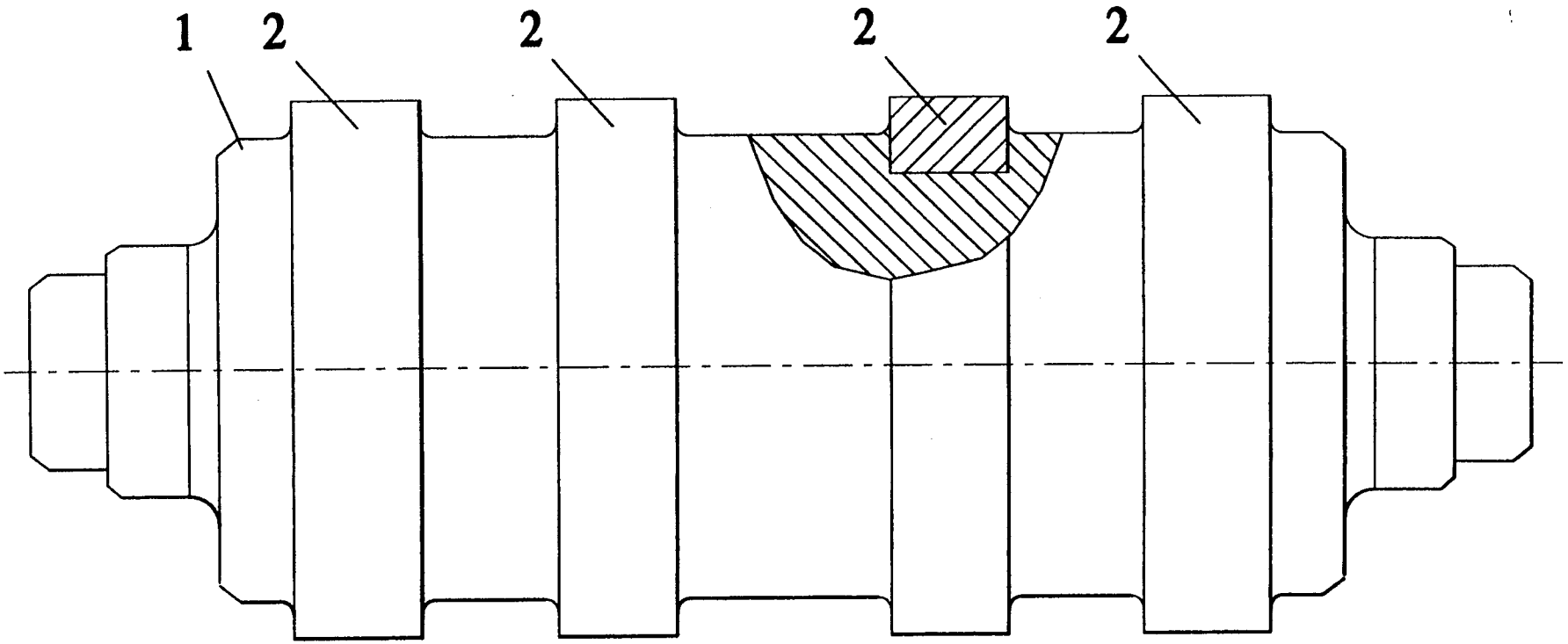
Figure 3:
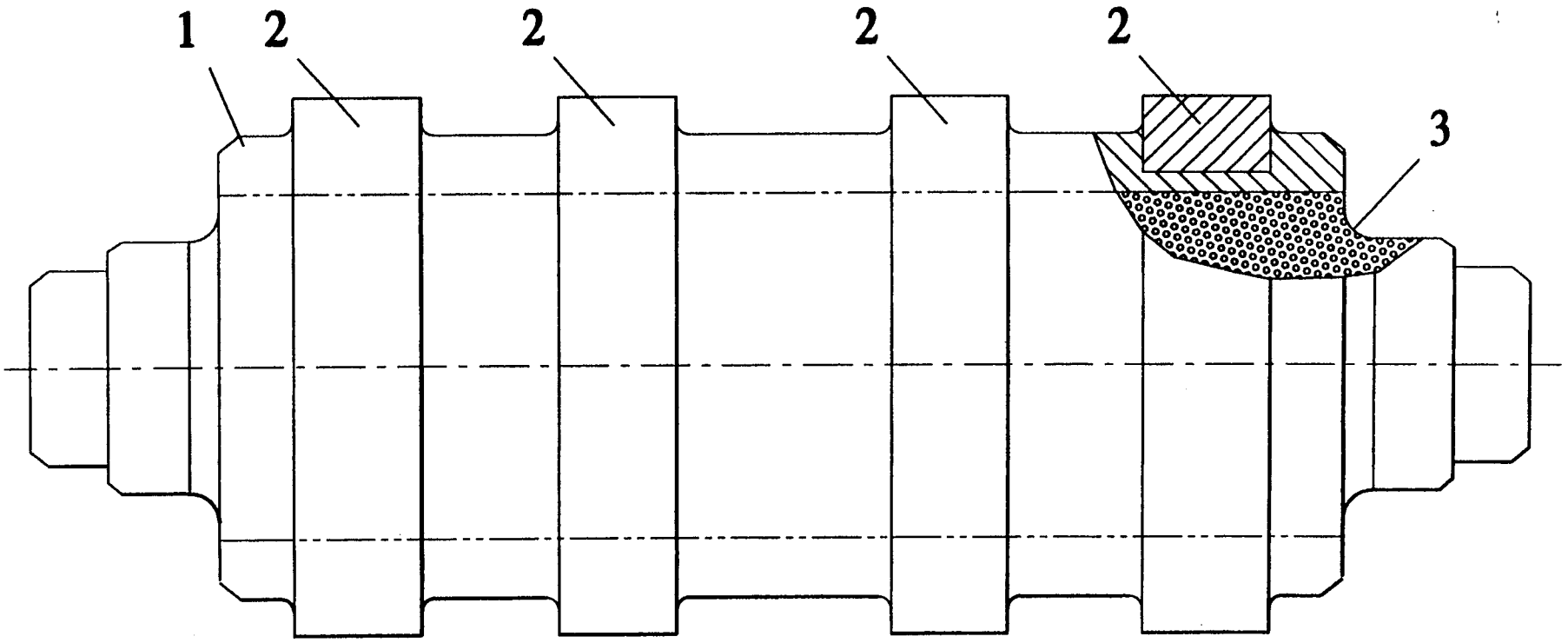
FIG. 3 shows a roll with four cemented carbide rings (2) cast in ductile iron (1) and with core and journals in another material (3).

FIGS. 1, 2 and 3 show some alternative embodiments. Other variations will be apparent to the skilled artisan.

The molding of the cemented carbide ring or rings in the foundry sand must be made in such a way that the molten east iron is prevented from reaching the outer surface of the cemented carbide ring. This is proven to be possible by the invention.

The outer surface of the cemented-carbide ring (or rings) forms the barrel of the manufactured composite roll. Experience from previous manufacture of cast-in roll rings, according to U.S. Pat. No. 5,044,056, shows that a small amount of molten cast iron, having penetrated the outer surface of the cemented carbide ring, results in deteriorated surface quality of the cemented carbide under the penetration surface. By machining one or a few millimeters of the outer surface of the cemented carbide ring, this surface deterioration can be removed. For successful manufacture of a composite roll according to the present invention, such surface penetrations must be avoided which according to the above, is possible.

In order to achieve an optimum metallurgical bond between cemented carbide and east iron, it is necessary to use high over-temperature of the iron in the cradle combined with amount controlled filling of the mold and a predetermined speed of rotation, in accordance with known techniques, to get a balanced heating and melting of a surface layer of the part of the cemented carbide ring which is not molded in the foundry sand, i.e., the part that shall be metallurgically bonded to the east iron.

The present composite roll comprises, after the necessary heat treatment and machining to final shape and dimension, a complete roll or roll ring. The difficulties with existing cemented carbide rolls to confidently transmit the torque from the driving spindle to the cemented carbide part, as previously described, has been eliminated with this composite roll.

According to the invention, the cemented carbide is east into an essentially graphitic east iron with a composition adjusted to the carbon equivalent, Ceqv., in a way described in U.S. Pat. No. 4,119,459, which is herein incorporated by reference. The composition of the east iron is also chosen with regard to optimum metallurgical bond to the cemented carbide, to its strength, toughness and hardness, all necessary for the transmission of the torque and to its machinability. By addition of ferrosilicon-magnesium and/or nickel-magnesium, the east alloy has a magnesium content of 0.02–0.10%, preferably 0.04–0.07%, by weight. By inoculation with ferrosilicon the cast iron has a silicon content of 1.9–2.8%, preferably 2.1–2.5%, by weight. Thereby, a ductile iron is obtained having dispersed, spheroidal graphite. This ductile iron has a hardness-touchness-strength which is well balanced to the application. In heat treated condition, the Brinell hardness is 250–300. Further, the iron shall be alloyed with austenite generating alloying elements, preferably nickel in amount of 3-10%, preferably 4–8%, by weight, resulting in a certain amount of residual austenitc viz. 5–30%, preferably 10–25%, most preferably 15–20%, by weight after the casting. By heat treatment in one or several steps, a suitable amount of residual austenitc can be transformed to other structure elements, for example, bainite, resulting in a volumetric expansion of the cast iron portion since bainite has a greater volume than austenite. This volume increase can be so adjusted that the differential shrinkage, taking place in the composite roll during cooling from the casting temperature, can be totally or partly eliminated. The method for this heat treatment is adjusted to cemented carbide grade, composition of the cast iron and to roll application. The heat treatment includes heating to and holding at a temperature of 800°–1000° C., cooling to and holding at a temperature of 400°–550° C., and cooling to room temperature.

In an alternative embodiment, the roll comprises a cemented carbide ring (or rings) and a casing of mentioned cast iron only, where the roll core and journals are cast of another casting alloy either by centrifugal or static casting.

In another alternative embodiment, the roll comprises a cemented carbide ring (or rings) cast into a ring-shaped casing only.

According to the invention, there is also provided a method for manufacture of a complete cemented carbide equipped roll for hot or cold rolling. According to the method, at least one sintered cemented carbide ring is placed in a mold in conventional centrifugal casting equipment with the bore surface of the ring and its side surfaces free to establish contact between the cemented carbide and the cast iron. The mold is rotated and when proper speed is achieved, a molten cast iron with above-described composition and at a suitable temperature is tapped down into the rotating mold. The molten iron is slung against the wall of the mold and solidifies under pressure. After cooling to room temperature, the roll is cleaned and is then heat treated according to the above.

According to an alternative method, a cemented carbide ring (or rings) is cast into a casing of mentioned cast iron only, after which core and journals are cast of another cast alloy either by centrifugal or static casting.

According to another alternative embodiment, a cemented carbide ring (or rings) is cast into a ring-shaped casing only, by centrifugal casting.

The invention is additionally illustrated in connection with the following Example which is to be considered as illustrative of the present invention. It should be understood, however, that the invention is not limited to the specific details of the Example.

EXAMPLE

A sintered cemented carbide ring with the composition 70% tungsten carbide (WC), 13% cobalt (Co), 15% nickel (Ni), 2% chromium (Cr), all percent by weight, was molded in foundry sand in a mold in a vertical centrifugal casting machine. The dimensions of the cemented carbide ring were:

outer diameter 340 mm inner diameter 260 mm width 100 mm

After molding, the bore surface of the cemented carbide ring and its side surfaces between the inner diameter and a diameter of 310 mm were free in order to there cream a metallurgical bond between the cemented carbide and the cast iron.

The mold was put to rotate at 400 revolutions per minute. A cast iron melt, with the composition 3.7% carbon (C), 2.3% silicon (Si), 0.3% manganese (Mn), 5.4% nickel (Ni), 0.2% molybdenum (Mo), 0.05% magnesium (Mg) and the balance iron (Fe), all percent by weight, at a temperature of 1540° C. was tapped into the rotating mold. The duration of pouring was about 1 minute. During that time, the rotation gradually ceased.

After cooling, the composite roll was cleaned and checked by an ultrasonic method. The quality of the metallurgical bond was good.

The roll was heat treated, with the aim of transforming the residual austenitc to bainite, by heating to 900° C., holding time 6 hours, then cooling to 450° C., holding time 4 hours, followed by cooling to room temperature. The freely exposed surfaces of the cemented carbide ring were covered with an anti-oxidizing agent, as the heat treatment was performed in open air. The roll dimensions were:

barrel: $\phi$310 mm (cemented carbide $\phi$340 mm)$\times$500 mm journals: $\phi$220$\times$300 mm+220$\times$520 mm The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A method of forming a roll ring comprising sintering a cemented carbide into a ring of predetermined size, thereafter casting iron about a portion of said cemented carbide ring to form a composite body barrel including a metallurgical bond between the cemented carbide and the cast iron, said cast iron having a microstructure comprising austenite and bainite, said barrel being east in one piece and thereafter heat treating the composite body to convert at least a portion of the austenite to bainite, the differential shrinkage during cooling after casting between the east iron body and the ring of cemented carbide being at least partly eliminated by the transformation of austenitc to battle.

2. The method of claim 1 wherein the casting is made by centrifugal casting technique.

3. The method of claim 1 wherein said barrel includes journal portions.

4. The method of claim 1 wherein after said cast iron is formed, a core is cast within said composite body barrel.

5. The method of claim 4 wherein the said core is cast of a different east alloy than said cast iron.

* * * * *